US011466376B1

(12) United States Patent
Freiderich

(10) Patent No.: US 11,466,376 B1
(45) **Date of Patent: *Oct. 11, 2022**

(54) LOW TEMPERATURE LITHIUM PRODUCTION

(71) Applicant: Consolidated Nuclear Security, LLC, Oak Ridge, TN (US)

(72) Inventor: John W. Freiderich, Oak Ridge, TN (US)

(73) Assignee: CONSOLIDATED NUCLEAR SECURITY, LLC, Oak Ridge, TN (US)

( * ) Notice: Subject to any disclaimer, the term of this patent is extended or adjusted under 35 U.S.C. 154(b) by 47 days.

This patent is subject to a terminal disclaimer.

(21) Appl. No.: 16/908,916

(22) Filed: Jun. 23, 2020

Related U.S. Application Data

(63) Continuation-in-part of application No. 15/925,007, filed on Mar. 19, 2018, now Pat. No. 10,718,057.

(51) Int. Cl.
*C25C 3/02* (2006.01)
*C25C 1/02* (2006.01)

(52) U.S. Cl.
CPC . *C25C 3/02* (2013.01); *C25C 1/02* (2013.01)

(58) Field of Classification Search
CPC ..... C25C 1/02; C25C 3/02
USPC ..... 205/407, 560
See application file for complete search history.

(56) References Cited

U.S. PATENT DOCUMENTS 4,455,202 A 6/1984 Sintim-Damoa et al.
7,550,028 B2 6/2009 Riquet et al.
7,713,396 B2 5/2010 Kakuta et al.
7,820,317 B2 10/2010 Tedjar et al.
10,718,057 B1 * 7/2020 Freiderich ..... C25C 1/02
2005/0100793 A1 5/2005 Jonghe et al.
2006/0204855 A1 * 9/2006 Saruwatari ..... H01M 4/622 429/324
2009/0017386 A1 1/2009 Xu et al.
2009/0325065 A1 12/2009 Fujii et al.
2014/0147330 A1 5/2014 Lee et al.
2015/0014184 A1 1/2015 Swonger
2016/0351889 A1 12/2016 Swonger et al.
2020/0086281 A1 * 3/2020 Hryn ..... H01M 4/382
(Continued)

OTHER PUBLICATIONS

Kipouros, G.J.; Sadoway, D. R., "Toward New Technologies for the Production of Lithium," JOM, May 1998, pp. 24-25.

*Primary Examiner* — Harry D Wilkins, III
(74) *Attorney, Agent, or Firm* — Luedeka Neely Group, PC

(57) ABSTRACT

A method and electrolysis cell for producing lithium metal at a low temperature. The method includes combining (i) acetonitrile and (ii) a cation bis(trihaloalkylsulfonyl)imide, cation bis(trihalosulfonyl)imidic acid, a cation bis(trihaloalkylsulfonyl)amide, or cation bis(trihaloalkylsulfonyl)amidic acid in a weight ratio of (i) to (ii) about 100:1 to about 5:1 to provide a non-aqueous electrolyte composition. A lithium compound selected from the group consisting of LiOH, $Li_2O$ and $Li_2CO_3$ is dissolved in the electrolyte composition to provide a lithium doped electrolyte composition. Power is applied to the electrolyte composition to form lithium metal on a cathode of an electrolysis cell. The lithium metal separated from the cathode has a purity of at least about 95 wt. %.

26 Claims, 1 Drawing Sheet

(56) References Cited

U.S. PATENT DOCUMENTS

2020/0091509 A1* 3/2020 Hryn ..... C25C 7/005
2020/0106127 A1* 4/2020 Ignacio de Leon .. H01M 10/54

* cited by examiner

LOW TEMPERATURE LITHIUM PRODUCTION

RELATED APPLICATION

This application is a continuation-in part of application Ser. No. 15/925,007, filed Mar. 19, 2018, now allowed.

GOVERNMENT RIGHTS

The U.S. Government has rights to this invention pursuant to contract number DE-NA0001942 between the U.S. Department of Energy and Consolidated Nuclear Security, LLC.

FIELD

The disclosure relates to the field of material processing. More particularly, this disclosure relates to lithium production by an electrolysis process.

BACKGROUND

Lithium is a chemical element belonging to the alkali metal group and is soft, silvery-white, and corrosive. Lithium is an increasingly valuable metal for use in alloys for heat transfer applications, rechargeable batteries, and the like. A conventional procedure for the production of lithium metal includes crystallization of lithium chloride from an aqueous concentrated solution of lithium chloride, then electrolysis of molten lithium chloride from a eutectic mixture containing 43 to 46 wt. % lithium chloride and 54 to 57 wt. % potassium chloride. The eutectic mixture melts at 352° C. and thus requires use of materials that can withstand high temperatures in a corrosive environment. The molten-salt electrolysis process is a high-temperature process, which has high energy consumption, requires high production costs, and has a significant effect on the environment. The lithium metal resulting from the molten-salt electrolysis process typically contains impurities such as sodium and thus cannot be used in battery applications.

Lithium metal has also been produced in an electrolysis cell under an inert atmosphere at about room temperature. The process includes dissolving a lithium salt selected from LiTFSI, LiCl, LiF, $LiPF_6$, and $LiBF_4$ in a conductive non-aqueous solvent. The non-aqueous conductive solvent contains a bis(trifluoromethylsulfonyl)imide (TFSI) anion and may comprise at least one compound selected from 1-butyl-3-methyl-pyridinium bis(trifluoromethylsulfonyl)imide, 1-methyl-propylpiperidinium bis(trifluoromethylsulfonyl) imide, and 1-ethyl-3-methyl-imidazolium bis(trifluoromethylsulfonyl)imide. The lithium salt is dissolved in a maximum amount of 30 wt. % with respect to the total weight of the solution. Re-oxidation of reduced lithium is avoided by the absence of an oxygen atmosphere. The foregoing process provides lithium metal that contains impurities that is plated onto the cathode. Purification of the lithium metal is performed by heat treating the deposited lithium at 800 to 900° C. for 30 to 90 minutes in an inert gas atmosphere.

The foregoing processes are difficult to conduct in a large scale industrial process and/or high temperatures, typically well above 3500° C., to produce lithium metal. Also, a subsequent purification step is often required to produce lithium with a purity of greater than 95 wt. % Accordingly, what is needed is a low temperature process that produces lithium metal with purities that are suitable for battery and other applications without the need for a subsequent purification step.

SUMMARY

The present disclosure provides a method for producing lithium metal at a low temperature in an electrolysis cell, where the low temperature is a temperature typically below the melting point of lithium (180° C.). The method includes combining (i) acetonitrile and (ii) a cation bis(trihaloalkylsulfonyl)imide, a cation bis(trihalosulfonyl)imidic acid, a cation bis(halosulfonyl)amide, or a cation bis(halosulfonyl) amidic acid in a weight ratio of (i) to (ii) of about 100:1 to about 5:1 to provide a non-aqueous electrolyte composition. A lithium compound selected from the group consisting of LiOH, $Li_2O$ and $Li_2CO_3$ is dissolved in the electrolyte composition to provide a lithium doped electrolyte composition. Power is applied to the anode and cathode to form lithium metal on the cathode of the electrolysis cell. The lithium metal is separated from the cathode and has a purity of greater than 95 wt. %.

Another embodiment of the disclosure provides an electrolysis cell for producing lithium metal at a temperature typically below about 180° C. The electrolysis cell includes a cathode compartment comprising a cathode, an anode compartment comprising an anode, a separator between the anode compartment and the cathode compartment, and a non-aqueous electrolyte composition in the anode and cathode compartments. The metal anode and metal cathode are selected from gold, platinum, tungsten, iron, copper and other precious and non-precious metals, as well as non-metal materials. The metal and non-metal materials are particularly selected from metals and non-metals that do not readily form intermetallic compositions with lithium. The non-aqueous electrolyte includes (i) acetonitrile and (ii) a cation bis(trihaloalkylsulfonyl)imide, a cation bis(trihalosulfonyl)imidic acid, a cation bis(halosulfonyl)amide, or a cation bis(halosulfonyl)amidic acid in a weight ratio of (i) to (ii) about 100:1 to about 5:1. A lithium compound selected from the group consisting of LiOH, $Li_2O$ and $Li_2CO_3$ is dissolved in the electrolyte composition to provide a lithium doped electrolyte composition. Power is applied to the anode and cathode to form lithium metal on the cathode of the electrolysis cell. The lithium metal is separated from the cathode and has a purity of greater than 95 wt. %.

In some embodiments, the weight ratio of (i) to (ii) of the non-aqueous electrolyte composition is about 20:1 about 10:1.

In some embodiments a weight ratio of non-aqueous electrolyte composition to the lithium compound) ranges from about 5:1 to about 2:3, and in more preferable embodiments the weight ratio ranges from about 3:1 to about 3:4.

In some embodiments the electrolyte composition and/or lithium doped electrolyte composition further includes a zwitterion or internal salt compound. In some embodiments, the zwitterion comprises a (carboxyalkyl)trialkyl ammonium compound.

In some embodiments, the lithium doped electrolyte composition is at a temperature ranging from about 0° to less than about 180° C. In other embodiments, the lithium doped electrolyte composition is at a temperature ranging from about 0° to less than about 100° C. In other embodiments, the lithium doped electrolyte composition is at a temperature ranging from about 15° to less than about 81° C. In yet other embodiments, the electrolysis cell contains the lithium doped electrolyte composition at a temperature ranging from about 20° to less than about 27° C.

In some embodiments heat is applied to the lithium doped electrolyte composition. In other embodiments power is applied to the anode and cathode at a current density ranging from about 0.1 $mA/cm^2$ to about 2.5 $mA/cm^2$.

In some embodiments the electrolysis cell includes an anode compartment, a cathode compartment and a separator between the anode compartment and the cathode compartment. In other embodiments the separator is selected from a fritted glass separator, a microporous membrane, and a salt bridge.

In some embodiments, the cation is selected from a phosphonium ion, a sulfonium ion, an ammonium ion, an imidazolium ion, a piperidinium ion, a pyridinium ion and a pyrrolidinium ion. In other embodiments, the cation is selected from an alkali metal, an alkaline earth metal, a metalloid, a transition metal, and a lanthanide.

In some embodiments, the halo ion is a fluoride ion. In other embodiments the alkyl group is a methyl group.

A particular advantage of the method and electrolysis cell described herein is that lithium metal may be produced with a purity of greater than 95 wt. % and even 99 wt. % or greater using a unique solvent in a one-pot process without the need for a subsequent high temperature purification step.

BRIEF DESCRIPTION OF THE DRAWINGS

Various advantages are apparent by reference to the detailed description in conjunction with the figure, wherein elements are not to scale so as to more clearly show the details, wherein.

DETAILED DESCRIPTION

Figure 1:
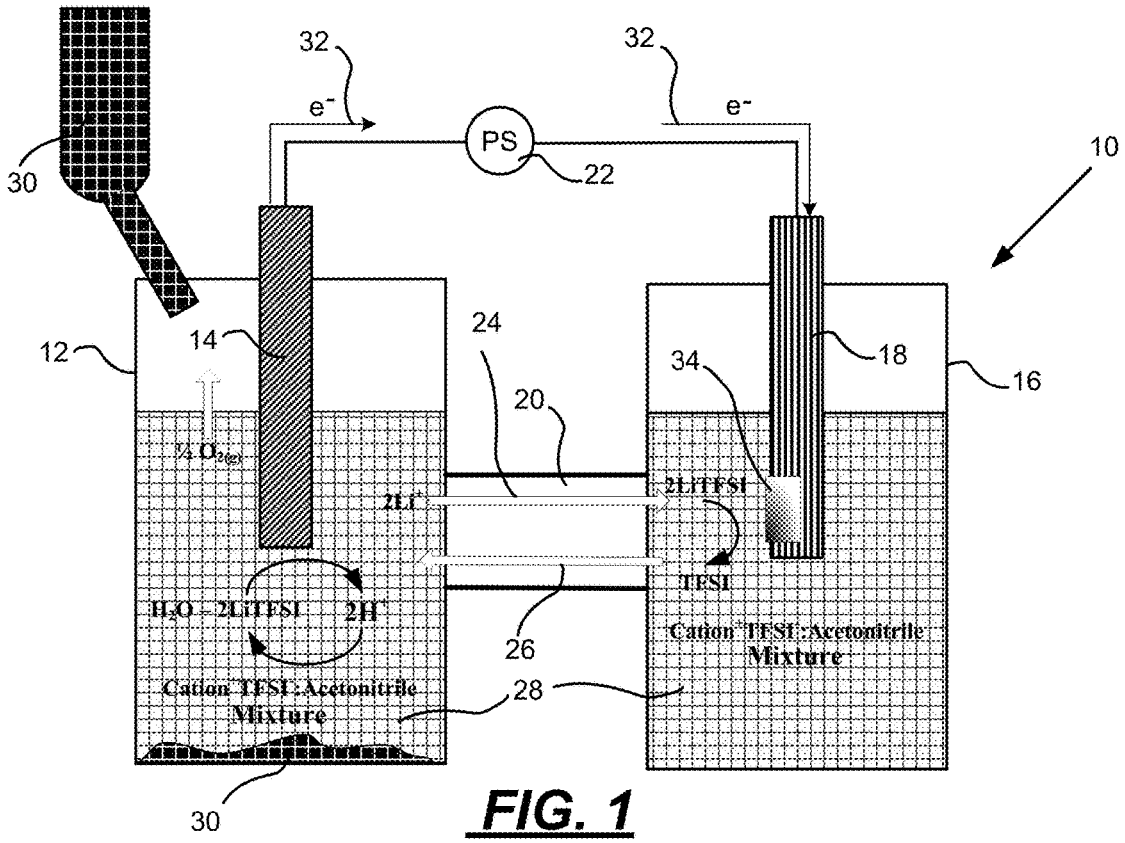
FIG. 1 is a schematic drawing of an electrolysis cell illustrating a method for making lithium metal according to the disclosure.

In the following detailed description of the preferred and other embodiments, reference is made to the accompanying drawings, which form a part hereof, and within which are shown by way of illustration the practice of a specific embodiment of a lithium processing apparatus and method of processing lithium metal. It is to be understood that other embodiments may be utilized, and that structural changes may be made and processes may vary in other embodiments.

There are several steps involved in producing relatively pure lithium metal from a lithium compound. "Relatively pure" in this disclosure means the lithium metal has a purity, as made, above 95 wt. %, such as above 97 wt. % and suitably from about 98 to at least 99 wt. %. In the first step of the method, there is provided a non-aqueous, molten electrolyte composition that includes a composition of (i) acetonitrile and (ii) a cation bis(trihaloalkylsulfonyl)imide or cation bis(halosulfonyl)amide wherein the cation may be (a) an organic cation selected from a phosphonium, a sulfonium, an ammonium, an imidazolium, a piperidinium, a pyridinium, a pyrrolidinium cation, or any combination thereof and the like with varying functionality, or (b) an inorganic cation selected from alkali metal, alkaline earth metal, metalloid, transition metal, lanthanide, or any combination thereof. The bis-imide may be selected from bis (trifluoromethanesulfonyl)imide, bis(trifluoroethanesulfonyl)imide, bis(trichloromethanesulfonyl)imide, bis (tricloroethane-sulfonyl)imide, bis (tribromomethanesulfonyl)imide, bis(tribromoethanesulfonyl)imide, and the like (hereinafter referred to as "TFSI" ionic liquid. Other compounds that may be used to form a low melting electrolyte composition with acetonitrile, include but are not limited to 1-butyl-3-methylimidazolium chloride, trioctylmethylammonium chloride, and the like.

The electrolyte composition of (i) and (ii) may be any combination of components (i) and (ii), but has a weight ratio of (i) to (ii) of about 100:1 to about 5:1. A particularly useful weight ratio of (i) to (ii) is about 20:1 to 10:1.

A lithium compound selected from the group consisting of LiOH, $Li_2O$ and $Li_2CO_3$ is dissolved in the electrolyte composition to provide a lithium doped electrolyte composition.

In some embodiments a weight ratio of electrolyte composition to the lithium compound ranges from about 5:1 to about 2:3, and in more preferable embodiments the weight ratio ranges from about 3:1 to about 3:4.

Acidic forms of bis(halosulfonyl)amine (hereinafter "FSA") or $TFSI^-$ anion may be readily dissolved in the non-aqueous electrolyte composition containing (i) and (ii). Such acidic forms include bis(trihaloalkylsulfonyl)-imidic acid (hereinafter "HTFSI").

An optional component of the electrolyte composition may be a zwitterion or internal salt compound such as a betaine. A suitable betaine may be selected from (carboxyalkyl)tri-alkylammonium inner salt such as (carboxymethyl) trimethylammonium compound, (carboxyethyl)trimethylammonium compound, (carboxymethyl)triethylammonium compound, and the like. The zwitterion or internal salt may aid in the dissolution of the lithium compound in the electrolyte composition.

Surprisingly, and quite unexpectedly, the lithium metal plated onto the cathode in the cathode compartment has a purity that does not require additional purification subsequent to the electrolysis step of the process for many applications requiring relatively pure lithium metal, such as battery applications. It is believed that the presence of component (i), the acetonitrile, significantly improves the solubility of the lithium compounds in the electrolyte composition.

Suitable lithium compounds that may be electrolyzed to form lithium metal may be selected from $Li_2O$, $Li_2S$, $Li_2Se$, $LiCoO_2$, $Li_2Te$, or lithium intercalated into a carbon support; lithium sulfates such as $Li_2SO_4$; lithium hydroxides such as LiOH; lithium carbonates such as $Li_2CO_3$ or $LiHCO_3$ bicarbonate; lithium silicates such as $Li_4SiO_4$ or $Li_2SiO_3$; lithium nitrates such as $LiNO_3$; lithium phosphates such as $Li_3PO_4$; lithium borates such as $LiBO_2$ metaborate; lithium aluminates such as $Li_2Al_2O_4$; the lithium oxide type minerals spodumene ($LiAlSi_2O_6$), petalite ($LiAlSi_4O_{10}$), lepidolite (mica with 3-4 weight percent $Li_2O$), hectorite which is a smectite clay of composition $Na_{0.33}(Mg, Li)_3Si_4O_{10}(F,OH)_2$; and compositions thereof. Of the foregoing, LiOH, $Li_2O$ and $Li_2CO_3$ are particularly preferred. Accordingly, embodiments of the disclosure avoid the use of lithium salts such as LiCl, LiF, $LiPF_6$ and $LiBF_4$ which form halogens upon electrolysis thereof. Another advantage of the electrolyte composition containing components (i) and (ii) described above is that the composition may enable the deposition of lithium metal on the cathode without the need for an inert gas atmosphere. However, an inert gas atmosphere such as argon may be used to reduce the likelihood of reaction of lithium metal with oxygen and moisture.

Referring to FIG. 1, a schematic drawing of an electrolysis cell 10 for producing lithium metal according to an embodiment of the present disclosure is shown. For simplicity, FIG. 1 only shows LiTFSI as the acidic reaction product. However, it will be appreciated that LiFSA may also be an alternative acidic reaction product. The electrolysis cell 10 includes an anode compartment 12 containing an anode 14, a cathode compartment 16 containing a cathode 18, a separator 20 between the anode compartment 12 and cathode compartment 16, and a power supply 22. The anode 14 may be selected from carbon, an inert noble metal such as platinum, or a conducting ceramic material; but carbon is the preferred material since carbon is inexpensive relative to the noble metals and ceramics. The cathode 18 may be made from tin, lead, iron, copper, cadmium, bismuth, indium, thallium, tungsten, zinc, calcium, aluminum, antimony, silver, gold, germanium, silicon, tellurium, magnesium, gallium, and mixtures thereof. The anode compartment 12 and cathode compartment 16 may be made from a borosilicate glass, quartz, ceramic, high temperature polymeric material, polytetrafluoroethylene, a noble metal, nickel alloy, or other inert material that does not react with the electrolyte composition.

The separator 20 between the anode compartment 12 and the cathode compartment 16 enables the flow of lithium ionic compounds from the anode compartment 12 to the cathode compartment 16 (arrow 24) and the flow of lithium depleted FSA or TFSI compounds from the cathode compartment 16 to the anode compartment 12 (arrow 26). A particularly suitable separator 20 may be a fritted glass salt bridge having a porosity ranging from 4 to 90 microns, such as from about 4 to 15 microns. Other separators 20 may be selected from permionic membranes, microporous membranes, and the like.

Each compartment 12 and 16 is loaded with a low melting lithium doped electrolyte composition 28 that is produced by combining acetonitrile with a cation bis(trihaloalkylsulfonyl)imide ($cation^+TFSI^-$) or a cation bis(halosulfonyl)amide ($cation^+FSA^-$). In one embodiment, the composition by weight is about 20:1 to about 10:1 acetonitrile to $cation^+TFSI^-$ or $cation^+FSA^-$, which has been found to have relatively low viscosity, good fluidity, and high solubility for LiTFSI or LiFSA, respectively.

During the electrolysis process, as shown in FIG. 1, the following electrochemical and chemical reactions occur when power is applied across the electrolysis cell 10 by the power supply 22:

1) In the cathode compartment 16: $2\ LiTFSI+2e^- \rightarrow 2Li_{(s)}+2TFSI$
2) In the anode compartment 12: (a) $2HTFSI+Li\ compound \rightarrow 2LiTFSI+H_2O$ and (b) $H_2O \rightarrow 2H^++2e^-+\frac{1}{2}O_{2(g)}$.

As seen by the foregoing reactions, the lithium compound 30 reacts with an acidic form of TFSI to produce 2LiTFSI and water in the lithium doped electrolyte composition 28. Application of power to the electrolysis cell causes the decomposition of water in the lithium doped electrolyte composition 28 to hydrogen and oxygen. The power may be applied at a power density ranging from about 0.1 $mA/cm^2$ to about 2.5 $mA/cm^2$. Hydrogen ion further reacts with the TFSI to produce the acid form of TFSI which dissolves additional lithium compound 30. A source of lithium compound 30 may be added intermittingly between batches or continuously added to the anode compartment 12 during the electrolysis process as the lithium compound 30 is consumed by the reaction. LiTFSI may also be preloaded into the cathode compartment 16 to mitigate any concentration gradient that is initially present in the electrolysis cell 10.

With agitation or a mild application of heat, the lithium doped electrolyte composition 28 remains liquid and the lithium compound 30 is readily dissolved in the lithium doped electrolyte composition 28. The electrolysis cell 10 may be operated at a wide range of low temperatures, typically ranging from about 0° C. to less than about 180° C. Preferably, the operational temperature is below about 1000° C. More preferably, electrolysis cell 10 is operated between about 150° C. to less than about 810° C., and still more optimally between about 200° C. and less than about 27° C. When operating the electrolysis cell 10 at temperatures at or above the flashpoint (2° C.) of acetonitrile, precautions should be taken to mitigate corrosion of lithium metal and to reduce the possibility of combustion. For example a cover gas, typically an inert gas, dry air, or use of a vacuum above the electrolyte composition may be used. When operating the electrolysis cell 10 at temperatures at or above the boiling point (81° C.) of acetonitrile, the vapor pressure of the acetonitrile displaces the oxygen and other gasses, thereby also mitigating corrosion of lithium metal and reducing the possibility of combustion.

Electrons flow in the direction of arrows 32 from the anode 14 to the cathode 18 wherein lithium metal 34 is reduced from the lithium doped electrolyte composition 28 and plated onto the cathode 18. The metal lithium 34 has a purity of greater than 95 wt. %, such as from about 97 to at least 99 wt. %. The lithium metal 34 may be removed from the cathode 18, intermittingly or continuously, rinsed to remove traces of the lithium doped electrolyte composition 28, and collected for use. The process described above may be easily scaled to provide an industrial scale production of relatively pure lithium metal that does not require a subsequent high temperature purification step.

With reference to the following non-limiting example, other aspects of the invention may be illustrated.

Example

Figure 2:
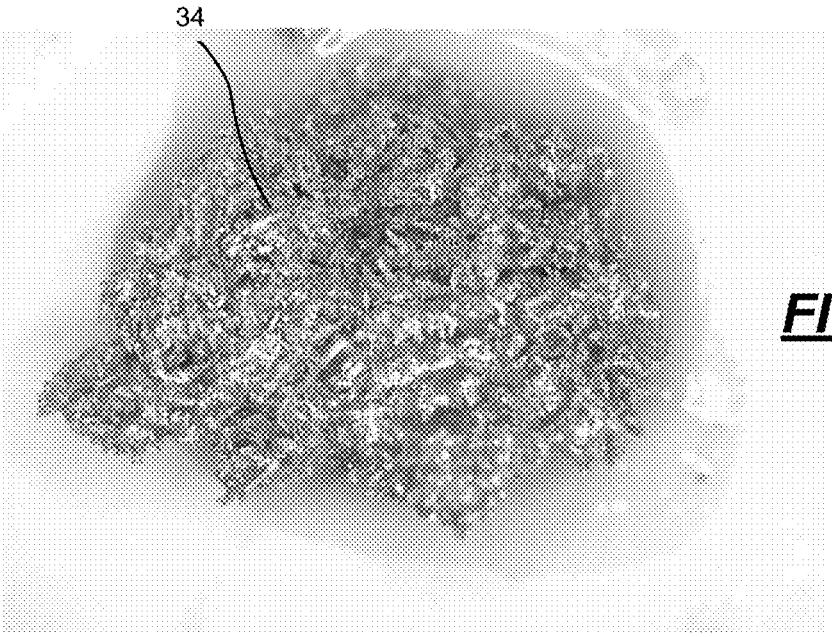
FIG. 2 is a photograph of lithium metal made using an electrolysis cell according to the disclosure.

A bulk deposition experiment was done in an H-cell with a fine frit salt bridge connector. The cathode compartment was loaded with 30 grams of a 5:1 wt. ratio acetonitrile: tetra-butylphosphoniumTFSI composition that was doped with LiTFSI to a final electrolyte to lithium compound weight ratio of 2:3, a tungsten cathode rod, and a platinum wire reference electrode. The anode compartment was loaded with 30 grams of the same lithium doped electrolyte composition used in the cathode compartment. The anode compartment was then loaded with 2 wt. % HTFSI, 10 grams of $Li_2O$ powder, and a carbon anode rod. The lithium doped electrolyte composition was heated to a temperature of about 54° C. and placed under an argon cover gas. Lithium was electrodeposited on the tungsten cathode rod at a current density of 1.2 $mA/cm^2$ and a voltage of about 7 volts across the electrolysis cell. A total of 3000 coulombs of charge were passed through the lithium doped electrolyte composition to produce 200 mg of Li at a coulombic efficiency of 91%. FIG. 2 is a photograph of 99 wt. % lithium metal 34 scraped off of the tungsten cathode 18 according to the foregoing procedure.

The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. A method of producing lithium metal in an electrolysis cell, the method comprising the steps of:

combining (i) acetonitrile and (ii) a cation bis(trihaloalkylsulfonyl)imide, a cation bis(trihalo-sulfonyl)imidic acid, a cation bis(trihaloalkylsulfonyl)amide, or a cation bis(trihaloalkylsulfonyl)amidic acid in a weight ratio of (i) to (ii) of about 100:1 to about 5:1 to provide a non-aqueous electrolyte composition, dissolving a lithium compound selected from the group consisting of LiOH, $Li_2O$ and $Li_2CO_3$ in the non-aqueous electrolyte composition to provide a doped lithium electrolyte composition, applying power to the electrolysis cell to form lithium metal on a cathode of an electrolysis cell, and separating lithium metal from the cathode, wherein the lithium metal on the cathode has a purity of at least about 95 wt. %.

2. The method of claim 1, wherein the doped lithium electrolyte composition further comprises a zwitterion or internal salt compound.

3. The method of claim 2, wherein the zwitterion comprises a (carboxyalkyl)trialkyl ammonium compound.

4. The method of claim 1, wherein the weight ratio of (i) to (ii) of the non-aqueous electrolyte composition is about 20:1 to 10:1.

5. The method of claim 1, wherein a weight ratio of non-aqueous electrolyte composition to lithium compound ranges from about 5:1 to about 2:3.

6. The method of claim 1, wherein a weight ratio of non-aqueous electrolyte composition to lithium compound ranges from about 3:1 to about 3:4.

7. The method of claim 1, wherein the doped lithium electrolyte composition is at a temperature ranging from about 0° to less than about 180° C.

8. The method of claim 1, wherein the doped lithium electrolyte composition is at a temperature ranging from about 0° to less than about 100° C.

9. The method of claim 1, wherein the doped lithium electrolyte composition is at a temperature ranging from about 15° to less than about 81° C.

10. The method of claim 1, wherein the electrolysis cell contains a cover gas above the doped lithium electrolyte composition.

11. The method of claim 1, wherein the electrolysis cell comprises an anode compartment, a cathode compartment and a separator between the anode compartment and the cathode compartment.

12. The method of claim 11, wherein the separator is selected from the group consisting of a fritted glass separator, a microporous membrane, and a salt bridge.

13. The method of claim 1, wherein the cation is selected from the group consisting of a phosphonium ion, a sulfonium ion, an ammonium ion, an imidazolium ion, a piperidinium ion, a pyridinium ion and a pyrrolidinium ion.

14. The method of claim 1, wherein the cation is selected from the group consisting of an alkali metal, an alkaline earth metal, a metalloid, a transition metal, and a lanthanide.

15. The method of claim 1, wherein the halo ion is a fluoride ion.

16. The method of claim 1, wherein the alkyl group is a methyl group.

17. The method of claim 1, wherein power is applied to the anode and cathode at a current density ranging from about 0.1 $mA/cm^2$ to about 2.5 $mA/cm^2$.

18. An electrolysis cell for producing lithium metal at a temperature comprising:

a cathode compartment comprising a cathode, an anode compartment comprising an anode, a separator between the anode compartment and the cathode compartment, a non-aqueous electrolyte composition in the anode and cathode compartments comprising (i) acetonitrile and (ii) a cation bis(trihaloalkylsulfonyl)imide, a cation bis(trihalosulfonyl)imidic acid, a cation bis(trihaloalkylsulfonyl)amide, or a cation bis(trihaloalkylsulfonyl) amidic acid in a weight ratio of (i) to (ii) of about 100:1 to about 5:1, wherein the electrolyte composition further comprises a lithium compound selected from the group consisting of LiOH, $Li_2O$ and $Li_2CO_3$ dissolved in the electrolyte composition, and wherein the separator is selected from the group consisting of a fritted glass separator, a microporous membrane, and a salt bridge, whereby power applied to the anode and cathode forms lithium metal on the cathode of the electrolysis cell with a lithium metal purity of greater than 95 wt. %.

19. The electrolysis cell of claim 18, wherein a weight ratio of non-aqueous electrolyte composition to lithium compound ranges from about 5:1 to about 2:3.

20. The electrolysis cell of claim 18, wherein the electrolyte composition further comprises a (carboxyalkyl)trialkyl ammonium compound.

21. The electrolysis cell of claim 18, wherein the cation is selected from the group consisting of a phosphonium ion, a sulfonium ion, an ammonium ion, an imidazolium ion, a piperidinium ion, a pyridinium ion, and a pyrrolidinium ion.

22. The electrolysis cell of claim 18, wherein the cation is selected from the group consisting of an alkali metal, an alkaline earth metal, a metalloid, a transition metal, and a lanthanide.

23. The electrolysis cell of claim 18, wherein the halo ion is a fluoride ion.

24. The electrolysis cell of claim 18, wherein the alkyl group is a methyl group.

25. The electrolysis cell of claim 18, wherein the electrolysis cell temperature is below about 180° C.

26. The electrolysis cell of claim 18, wherein the electrolysis cell contains a cover gas above the lithium compound dissolved in the electrolyte composition.

* * * * *